US006270276B1

(12) United States Patent
Virgo

(10) Patent No.: US 6,270,276 B1
(45) **Date of Patent: *Aug. 7, 2001**

(54) REFILLABLE RESERVOIR

(75) Inventor: Roger Virgo, Bogner Regis (GB)

(73) Assignee: Parker Pen Products, Isleworth (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/163,639

(22) Filed: Sep. 30, 1998

Related U.S. Application Data

(63) Continuation of application No. PCT/GB97/00974, filed on Apr. 8, 1997.

(30) Foreign Application Priority Data

Apr. 10, 1996 (GB) ..... 9607407

(51) Int. Cl.[7] ..... B43K 5/06
(52) U.S. Cl. ..... 401/221; 401/181
(58) Field of Search ..... 401/144, 181, 401/182, 189, 221; 222/392

(56) References Cited

U.S. PATENT DOCUMENTS

| | | | | |
|---|---|---|---|---|
| 14,425 | * | 3/1856 | Warren et al. | 401/182 |
| 874,738 | * | 12/1907 | Crawford | 401/181 |
| 1,025,511 | * | 5/1912 | Craven | 222/392 |
| 1,445,900 | | 2/1923 | McKay . | |
| 1,487,886 | * | 3/1924 | Rettig | 401/181 |
| 1,558,263 | | 10/1925 | Grommes . | |
| 1,559,968 | | 11/1925 | Kleschka . | |
| 1,615,312 | * | 1/1927 | Poetz | 401/182 |
| 1,865,325 | | 6/1932 | MacLeod . | |
| 2,557,634 | | 6/1951 | Cox | 120/47 |
| 3,229,865 | * | 1/1966 | Heisler et al. | 222/392 |
| 3,231,139 | * | 1/1966 | Bouet | 222/392 |
| 4,917,273 | * | 4/1990 | Seager | 401/181 |

FOREIGN PATENT DOCUMENTS

| | | | | |
|---|---|---|---|---|
| 247569 | * | 5/1912 | (DE) | 401/182 |
| 374270 | | 4/1923 | (DE) . | |
| 1005872 | | 4/1957 | (DE) . | |
| 0032091 | | 7/1981 | (EP) . | |
| 0664976 | | 8/1995 | (EP) . | |
| 952748 | | 11/1949 | (FR) . | |
| 1408868 | | 7/1965 | (FR) . | |
| 2137307 | | 12/1972 | (FR) . | |

* cited by examiner

*Primary Examiner*—Charles R. Eloshway
(74) *Attorney, Agent, or Firm*—Chester Cekala

(57) ABSTRACT

A refillable reservoir, particularly an ink converter for a fountain pen, has a cylinder in which a piston is slidable, and an actuating device for displacing the piston for refilling the ink chamber. Without needing to be detached from the piston, the actuating device can be stored substantially within the length of the chamber. The actuating device can be a rod which is disengageable from and slidable through the piston. Alternatively the actuating device can be a flexible ribbon coupled to a sleeve slidably mounted on the cylinder.

7 Claims, 3 Drawing Sheets

REFILLABLE RESERVOIR

This application is a continuation of copending International Application Serial No. PCT/GB 97/00974 filed Apr. 8, 1997.

This invention relates to refillable reservoirs for marking instruments, especially but not necessarily exclusively for fountain pens. The invention is particularly concerned with so-called fountain pen converters which can be fitted into fountain pens adapted to receive disposable ink cartridges which are replaced when the cartridges are depleted of ink. Converters can be refilled with ink from a bottle of ink.

Different forms of fountain pen converters are known. Most consist of a cylinder enclosing a chamber for holding the ink, and a piston movable to-and-fro along the cylinder for displacing air from the empty chamber and drawing ink into the chamber. The piston can be actuated by pushing and pulling a piston rod which is fixedly attached to the piston and protrudes through the rear end of the cylinder. This construction allows refilling operations to be completed quickly, but has the disadvantage that when the reservoir chamber is filled the piston rod projects a substantial axial distance beyond the end of the cylinder. As a consequence the piston rod takes up a relatively large portion of the length of the space available within the pen barrel and therefore restricts the maximum length of the cylinder and hence the volume of the ink chamber within it. In an attempt to alleviate this drawback it has been proposed to couple the piston rod to a rotatable sleeve through a screw thread arrangement so that rotation of the sleeve causes axial displacement of the piston rod and piston. A disadvantage of this construction is that the sleeve must be rotated through several revolutions to complete a full axial stroke of the piston, and refilling the reservoir takes a comparatively long time to perform. Furthermore, the sleeve, into which the piston extends when the piston is in its rearmost position, still extends a significant distance from the rear end of the cylinder. Another proposal has been to drive a piston by means of an annular magnet surrounding the cylinder, but this would require a large magnet which in turn would limit the diameter of the cylinder and restrict the volume of the ink chamber if the pen barrel is not to become unduly larger.

In GB-A-770090 there is disclosed a fountain pen with a barrel enclosing an ink chamber in which a piston is slidable, and a compartment for storing a detachable piston rod which can be inserted through a hole in the end of the barrel and be connected to the piston by a screw-thread when the chamber is to be refilled with ink. A detachable piston rod is inconvenient and carries with it the risk that it will become misplaced or lost.

The present invention addresses the above problem and as a solution is provides a refillable reservoir for a marking instrument comprising a cylinder enclosing a reservoir chamber, a piston axially slidable in the cylinder to expel air out of and draw fluid in through the forward end of the cylinder, and a device for actuating the piston having a part extending through a rear part of the cylinder for connection to the piston, the device being movable axially of the cylinder for directly driving the piston and, without becoming detached from the piston, being positionable substantially within the length of the cylinder when the chamber is filled.

In accordance with one embodiment there is provided a refillable reservoir comprising a cylinder enclosing a reservoir chamber, a piston axially slidable in the cylinder to expel air from and draw fluid into the cylinder through the forward end, and a piston rod protruding through the rear end of the cylinder for displacing the piston, the piston being annular and the piston rod being disengageable from the piston and movable through the piston to allow the piston rod to be disposed in an advanced position in the cylinder while the piston remains retracted.

It will be understood that the ability to uncouple the piston rod from the piston means that its projection from the cylinder may be minimal, even with the chamber filled with liquid, and thereby the cylinder can occupy more space within a barrel of the marking instrument and the chamber can have a larger volume for liquid storage.

In accordance with another embodiment there is provided a refillable reservoir comprising a cylinder enclosing a reservoir chamber, a piston axially slidable in the cylinder to expel air from and draw fluid into the chamber, an actuating member movable parallel with the cylinder and alongside the cylinder, and an elongate strip interconnecting the piston and actuating member for the piston to be driven by displacement of the actuating member.

As the actuating member is alongside the cylinder it doe not impose any restriction on the length of the cylinder within any particular pen barrel and it need not demand substantial radial space so that a large chamber volume is again permitted.

The actuating member may be slidingly guided by the cylinder and conveniently it takes the form of a sleeve or collar extending about the cylinder. The strip, is suitably a metal or plastic ribbon which can be guided in a longitudinal channel provided on the exterior of the cylinder. The strip is sufficiently flexible to enable it to be bent through 180° between sections of the strip located inside and outside the chamber, but is also sufficiently strong in tension and longitudinal compression to drive the piston oppositely to the actuating member when the latter is displaced for refilling the reservoir.

Although described specifically herein in relation to fountain pen converters it will be appreciated that the embodiments of the invention are suitable for other applications, e.g. in fountain pens with permanent refillable reservoirs, and in other types of marking instrument equipped with refillable reservoirs.

To assist a clear understanding of the invention some exemplary embodiments will now be described with reference to the accompanying drawings in which.

Figure 1:
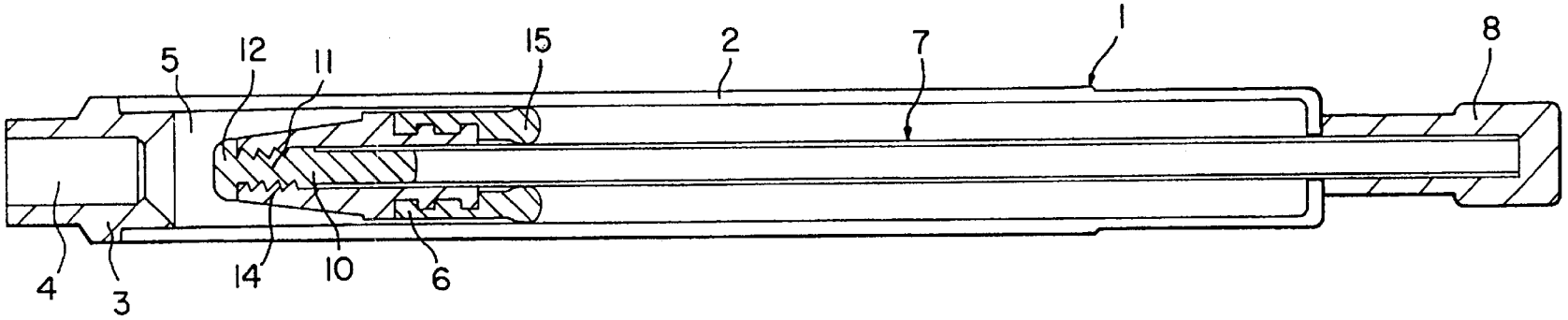
FIG. 1 is an axial section through a fountain pen converter in accordance with the invention and prepared ready to draw in ink to fill the reservoir chamber.
Figure 2:
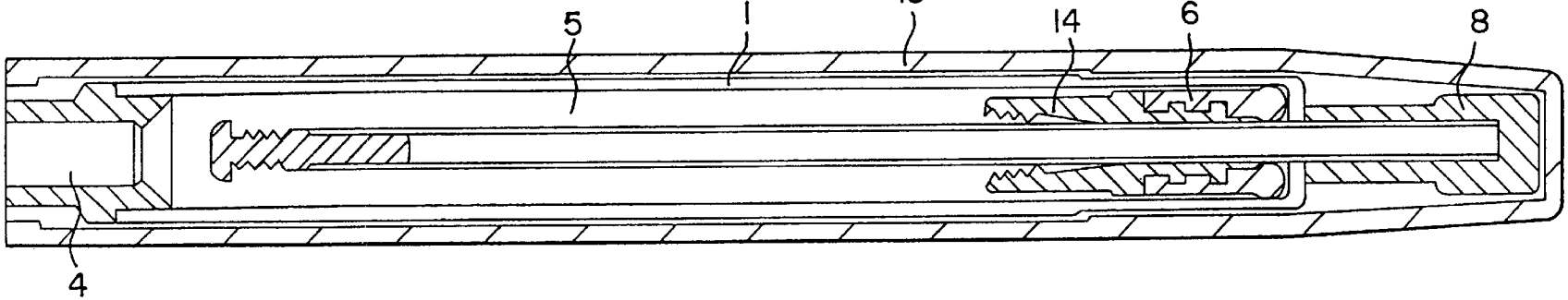
FIG. 2 shows the converter of FIG. 1 in an ink filled condition and housed within the barrel of a fountain pen.

The fountain pen converter illustrated in FIGS. 1 and 2 comprises a cylinder 1 with a main part 2 into the forward end of which is sealingly fitted a connection part 3 defining a spigot for connection to a writing instrument and having a central port 4 communicating with the ink reservoir chamber 5 enclosed within the cylinder. Slidable axially within the cylinder is an annular piston 6, and extending through the axial opening of the piston is a piston rod 7 which projects through the rear end of the cylinder and carries a push-pull button 8 on its outer end. The piston rod, conveniently formed from a metal tube, has a coupling member 10, secured to its forward end, this member leaving a plug portion fitted tightly into the tube, a screw-threaded intermediate section 11 and an enlarged head 12. The piston has a frustroconical forward extension 14 which is internally screw-threaded for cooperation with the coupling member of the piston rod, and the piston carries a seal 15 which seals against both the cylinder 2 and the piston rod 7.

With the piston and piston rod coupled together and in the position shown in FIG. 1, by pulling on the button 8 the piston can be drawn back along the cylinder to suck ink into the chamber 5 through the port 4. When the piston abuts the rear end wall of the cylinder the chamber is filled. By rotating the button 8 and piston rod 7, the coupling member 10 will be unscrewed from the piston extension 14, and the piston rod can then be pushed forwardly by means of the button 8, leaving the piston in its rearmost position. The piston rod will then occupy the normal position shown in FIG. 2 which shows the fountain pen converted housed with a pen barrel 18 and shows the small distance by which the piston rod projects from the cylinder when the reservoir chamber is filled. Furthermore, the piston rod at all times forms an integral part of the ink converter and it does not become completely detached from the piston. Although the forward movement of the piston rod through the piston may displace a small portion of ink from the chamber, there is still a large volume of ink retained in the chamber and available for writing with. When the chamber has been emptied and is to be refilled, after the pen barrel has been removed, the piston rod is pulled back and re-engaged with the piston by rotating the piston rod to threadedly connect the coupling member 10 and piston extension 14. The enlarged head 12 of the coupling member prevents the piston rod being withdrawn through the piston. The piston can then be pushed forwardly by means of the button 8 to expel air from the chamber 5 through the port 4 and bring the piston to the forwardmost position illustrated in FIG. 1 ready for refilling the reservoir as described above.

In order to facilitate rapid re-engagement of the piston with the coupling member of the piston rod, the piston extension 14 may be split axially to define a pair of jaws which are biased together but which are forced apart by the piston rod as shown in FIG. 2. When the piston rod is axially retracted, the jaws snap closed around the threaded sections of the coupling member 10.

Other modifications are possible without departing from the principles of the invention. For example the piston rod could have a bayonet type of releasable coupling, or any other form of coupling which can be engaged and released by manipulation of the end of the piston rod.

Figure 3:
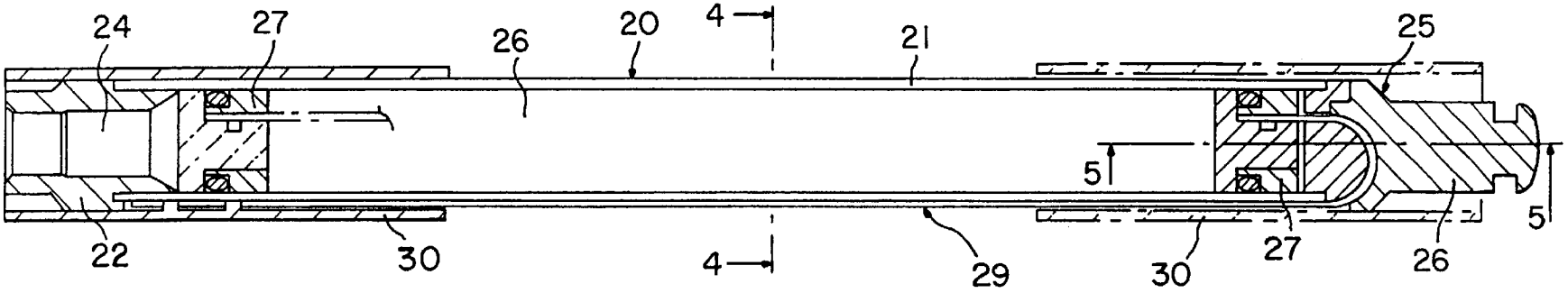
FIG. 3 is an axial section through another fountain pen converter in accordance with the invention.
Figure 5:
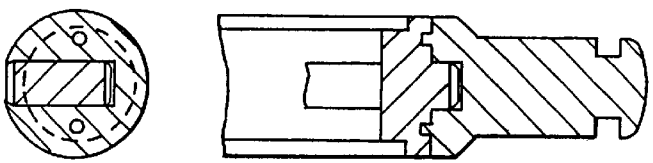
FIG. 5 is a partial axial section taken along the line V—V of FIG. 3.
Figure 4:
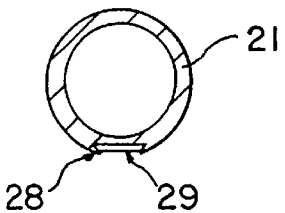
FIG. 4 is a transverse cross-section taken along the line IV—IV in FIG. 3.

The alternative embodiment of the invention shown in FIGS. 3, 4 and 5 has a cylinder 20 having a tubular main body part 21 fitted with a forward end part 22 providing the connection spigot and port 24, and a rear end closure 25. The cylinder encloses an ink reservoir chamber 26, and a piston 27 equipped with an O-ring seal is axially slidable along the cylinder . The axis of the bore through the tubular body part 21 is eccentric so that the wall thickness varies around the circumference as may be best seen in FIG. 4, and formed in the region of the thickest wall portion in a longitudinal channel 28 with undercut side walls. This channel servers to guide a plastics strap or ribbon 29 which interconnects the piston 27 with an actuating member in the form of a sleeve 30 which is axially slidable along the cylinder. One end of ribbon 29 is attached to the actuating sleeve, e.g. by a peg on the interior of the sleeve being inserted into a hole in the ribbon, and the other end of the ribbon is attached to the piston. Conveniently the piston is formed of two parts, one part having a peg which projects into a hole in the ribbon and the second part holding the ribbon against separation from the first part.

The end enclosure 25 of the cylinder is also formed of two parts or elements securely fixed together, and these two parts define a slot for guiding a portion of the ribbon through a 180° bend, one end of this slot being aligned with the end of the channel 28. The end closure 25 includes an integral button 26 for holding the cylinder during refilling operations. The ribbon 29 is sufficiently flexible to pass around the 180° bend, but is also sufficiently strong and stiff for the piston to be driven to and fro along the cylinder in response to sliding movement of the actuating sleeve 30 back and forth along the cylinder.

With the piston in a rear end position and the sleeve in a forwardmost position, as shown in FIG. 3, and assuming the reservoir chamber to be empty, by pushing the sleeve 30 backwards along the cylinder to the position indicated in broken line the piston will be driven forwardly to its forward end position, which is also shown in FIG. 3, thereby to expel air from the chamber out through the port 24. Sliding the sleeve 30 forwardly again causes the ribbon to pull the piston back to the rear end position for drawing ink into the chamber 26 through the port 24. It will be appreciated that the piston actuating mechanism occupies minimal space enabling a large volume reservoir to be provided within the confines of a pen barrel of normal dimensions.

Figure 6:
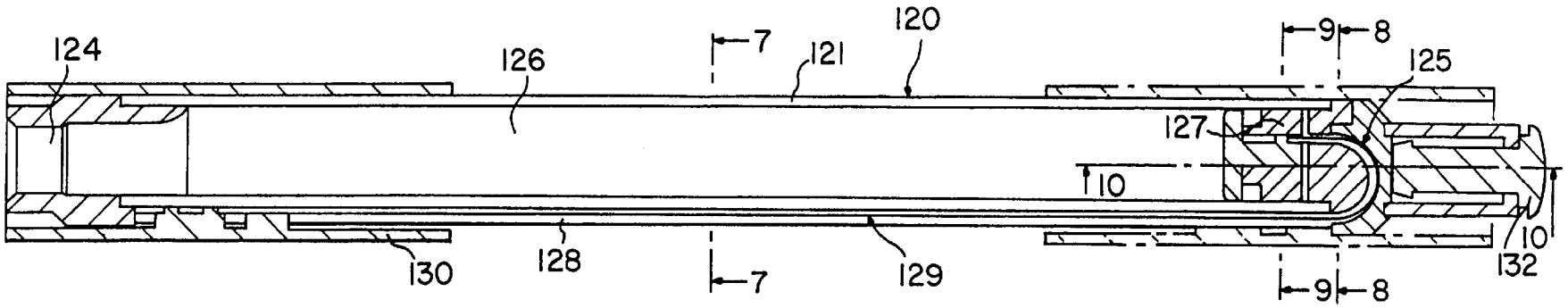
FIG. 6 is an axial section through modified fountain pen converter of similar construction to that of FIG. 3.
Figure 10:
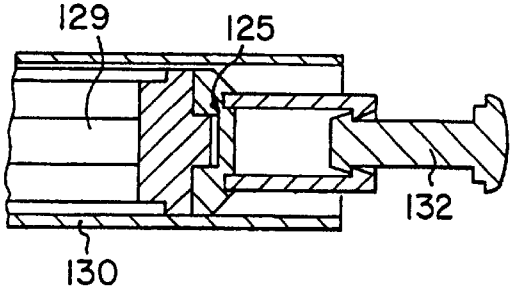
FIG. 10 is a partial axial section along the line X—X in FIG. 6.
Figure 7:
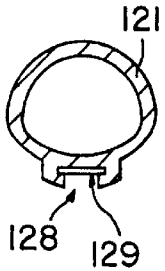
FIGS. 7, 8 and 9 are transverse cross-sections respectively taken along the lines VII—VII, VIII—VIII and IX—IX in FIG. 6.
Figure 8:
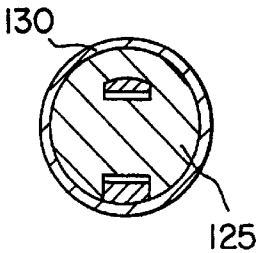
Figure 9:
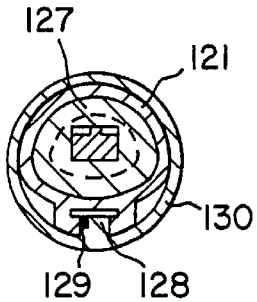

FIGS. 6 to 10 illustrate a modified fountain pen converter of the same basic form as that of FIGS. 3 to 5. The main body part 121 of the cylinder 120 is non-circular in cross section and has a uniform wall thickness, the ribbon guide channel 128 being formed by parallel longitudinal projections. The piston 127 is shaped to fit the bore of the cylinder and like the actuating sleeve 130 is attached to the ribbon 129, in case a metal strip, as described in connection with the previous embodiment. The rear end closure 125 of the cylinder defines a slot to guide the ribbon through a 180° bend, again as in the previous embodiment. The end closure has a tubular extension which receives and guides an extensible holding button 132 which is normally retracted as indicated in FIG. 6, but can be extended as shown in FIG. 10 for ease of holding the cylinder during reservoir refilling operations. The refilling operation is performed as described above for the embodiment of FIGS. 3 to 5. Sliding the sleeve 130 back along the cylinder causes the ribbon 129 to push the piston forwardly to expel the air through the port 124, and sliding the sleeve forwardly pulls the piston back to drawn in ink to fill the reservoir chamber 126.

What is claimed is:

1. A refillable reservoir for a pen comprising:

a) a cylinder enclosing a reservoir chamber;

b) a piston axially slidable in the cylinder to expel air out of and draw fluid in through the forward end of the cylinder;

c) a device for actuating the piston having a part extending through a rear part of the cylinder for connection to the piston, the device being movable axially of the cylinder for directly driving the piston and, without becoming detached from the piston, being positionable substantially within the length of the cylinder when the chamber is filled, wherein the actuating device comprises an actuating member comprising a sleeve extending about the cylinder, said sleeve being movable parallel with the cylinder axis and alongside the cylinder; and d) an elongated strip interconnecting the piston and the actuating member.

2. A refillable reservoir according to claim 1, wherein the actuating member is slidably guided on the cylinder.

3. A refillable reservoir according to claim 1, wherein the cylinder has a guide means extending along the exterior thereof for slidably guiding a section of the strip extending from the actuating member.

4. A refillable reservoir according to claim 3, wherein the guide means comprises a channel to receive the strip.

5. A refillable reservoir according to claim 1, wherein the rear end of the cylinder includes a slot through which the strip passes, the slot guiding the strip along a U-shaped path between strip sections located inside and outside the cylinder.

6. A refillable reservoir according to claim 5, wherein the slot is defined between two elements fastened securely together and closing the rear end of the chamber.

7. A refillable reservoir according to claim 6, wherein the strip is a metal ribbon.

* * * * *